US009525252B2

(12) United States Patent
Kim et al.

(10) Patent No.: US 9,525,252 B2
(45) Date of Patent: Dec. 20, 2016

(54) SOCKET OUTLET ASSEMBLY

(71) Applicants: Hojin Kim, Yongin-Si (KR); In Je Kim, Ansan-Si (KR)

(72) Inventors: Hojin Kim, Yongin-Si (KR); In Je Kim, Ansan-Si (KR)

( * ) Notice: Subject to any disclaimer, the term of this patent is extended or adjusted under 35 U.S.C. 154(b) by 0 days.

(21) Appl. No.: 15/103,491

(22) PCT Filed: Dec. 8, 2014

(86) PCT No.: PCT/KR2014/011980

§ 371 (c)(1),
(2) Date: Jun. 10, 2016

(87) PCT Pub. No.: WO2015/093767

PCT Pub. Date: Jun. 25, 2015

(65) Prior Publication Data

US 2016/0315433 A1 Oct. 27, 2016

(30) Foreign Application Priority Data

Dec. 16, 2013 (KR) ..... 10-2013-0156728

(51) Int. Cl.
*H01R 25/00* (2006.01)
*H01R 35/04* (2006.01)
*H01R 13/502* (2006.01)

(52) U.S. Cl.
CPC ..... *H01R 25/003* (2013.01); *H01R 13/502* (2013.01); *H01R 35/04* (2013.01)

(58) Field of Classification Search
CPC ..... H01R 25/003; H01R 13/502; H01R 31/06; H01R 35/04

(Continued)

(56) References Cited

U.S. PATENT DOCUMENTS 7,824,185 B2 * 11/2010 Chien ..... F21S 4/28 439/11
7,874,856 B1 * 1/2011 Schriefer ..... H01R 13/514 439/214

(Continued)

FOREIGN PATENT DOCUMENTS

JP 11-008034 1/1999
JP 11-283464 10/1999

(Continued)

OTHER PUBLICATIONS

International Search Report dated Dec. 26 2014. PCT/KR2014/011980.

*Primary Examiner* — Tulsidas C Patel
*Assistant Examiner* — Travis Chambers
(74) *Attorney, Agent, or Firm* — Dinsmore & Shohl LLP

(57) ABSTRACT

The present invention discloses a socket outlet assembly in which socket outlets that may be inserted into a plurality of electric plugs or USB terminals are continuously connected, and an interval of a plug insertion hole of the socket outlet inserted with the plug and the plug insertion hole of another socket outlet disposed to be adjacent thereto can be adjusted. In a socket outlet assembly according to the present invention including a plurality of unit socket outlets hinge-coupled to each other and having a varied shape, each unit socket outlet includes a body part made as a polyhedron, one or more hinge-coupling part integrally made with the body part and provided at a corner part side of the body part, an insertion hole part inserted with a plug in one surface of the body part, and a first power supply member and a second power supply member provided at the body part and the hinge-coupling part and supplying power from a power source to the insertion hole part.

7 Claims, 7 Drawing Sheets

(58) Field of Classification Search
USPC ..... 439/31, 165, 173, 640, 650, 651, 652
See application file for complete search history.

(56) References Cited

U.S. PATENT DOCUMENTS

| | | | | |
|---|---|---|---|---|
| 8,157,574 | B2 * | 4/2012 | Hsiao | H01R 13/4532 439/131 |
| 8,529,289 | B2 * | 9/2013 | Zien | H01R 25/003 439/527 |
| 2006/0234561 | A1 * | 10/2006 | Tanaka | H01R 25/003 439/652 |
| 2012/0028505 | A1 * | 2/2012 | Weber | H01R 25/003 439/638 |
| 2013/0023147 | A1 | 1/2013 | Zien et al. | |

FOREIGN PATENT DOCUMENTS

| | | |
|---|---|---|
| KR | 1020050075856 | 7/2005 |
| KR | 200455063 | 1/2013 |
| KR | 10-1288472 | 7/2013 |

* cited by examiner

SOCKET OUTLET ASSEMBLY

CROSS-REFERENCE TO RELATED APPLICATION

This application is the U.S. national stage of PCT/KR2014/011980 filed Dec. 8, 2014, which claims priority to and the benefit of Korean Patent Application No. 10-2013-0156728 filed in the Korean Intellectual Property Office on Dec. 16, 2013, the entire contents of which are incorporated herein by reference.

BACKGROUND OF THE INVENTION (a) Field of the Invention

The present invention relates to a socket outlet assembly in which socket outlets that may be inserted into a plurality of electric plugs or USB terminals are continuously connected, and to an interval of a plug insertion hole of the socket outlet inserted with the plug and the plug insertion hole of another socket outlet disposed to be adjacent thereto.

(b) Description of the Related Art

In general, in an electric socket outlet, holes for inserting electric plugs are continuously disposed. A power source may be used by inserting the plurality of electric plugs into the electric socket outlet. In this conventional electric socket outlet, since the insertion holes for inserting the electric plugs are fixed with a predetermined interval, when inserting the electric plugs having a relative large size into the socket outlet, the electric plugs may not be inserted into the electric plug insertion holes disposed to be adjacent to each other such that use thereof is inconvenient.

SUMMARY OF THE INVENTION

Technical Object

Accordingly, the present invention to solve the above-described problem provides a socket outlet assembly promoting convenience in use by successively inserting and using plugs having a relative large size when inserting the plugs or the USB terminals to the socket outlet.

The present invention also provides a socket outlet assembly that can be transformed into various shapes while reducing a production cost through a simple structure.

Technical Solution

To obtain the object of the present invention, a socket outlet assembly including a plurality of unit socket outlets hinge-coupled to each other and having a varied shape is provided.

The unit socket outlet include a body part made as a polyhedron, one or more hinge-coupling parts integrally made with the body part and provided at a corner part side of the body part, an insertion hole part inserted with a plug in one surface of the body part, and a first power supply member and a second power supply member provided at the body part and the hinge-coupling part and supplying power from a power source to the insertion hole part.

It is preferable that the polyhedron is made as a hexahedron.

It is preferable that the unit socket outlet is connected with a power supply unit, that the power supply unit includes a power body part made as a polyhedron, a power hinge-coupling part integrally made with the power body part and provided at a corner part side of the power body part, and a switch provided at the power body part and supplying or blocking power from the power source to the first power supply member and the second power supply member, and that the power hinge-coupling part provided at the power body part is hinge-coupled to the hinge-coupling part provided at the unit socket outlet.

It is preferable that the body part includes a lower body part and an upper body part coupled to the lower body part, that the hinge-coupling part includes a lower hinge-coupling part extending from the corner part side of the lower body part and an upper hinge-coupling part extending from the corner part side of the upper body part, and that the lower hinge-coupling part and the upper hinge-coupling part are coupled to another lower hinge-coupling part and another upper hinge-coupling part disposed to be adjacent by a fastening member.

It is preferable that the first power supply member has a terminal at the first plug fitting part and at both sides thereof, that the terminal of the first power supply member is disposed at the hinge-coupling part and contacts the terminal of another adjacent first power supply member, that the second power supply member includes another terminal at the second plug fitting part and at both sides thereof, that the terminal of the second power supply member is disposed at the hinge-coupling part and contacts the terminal of another adjacent second power supply member, and that the terminal of the first power supply member and the terminal of the second power supply member are insulated by a blocking member provided at the hinge-coupling part.

It is preferable that the blocking member is made with a cylindrical shape and is disposed between the terminal of the first power supply member and the terminal of the second power supply member.

It is preferable that a wave washer is respectively disposed at one side of the terminal of the first power supply member and the terminal of the second power supply member in the hinge-coupling part, wherein the wave washer has elastic force acting in a direction such that the terminal of the first power supply member maintains a contact state with the terminal of another adjacent first power supply member and the terminal of the second power supply member maintains a contact state with the terminal of another adjacent second power supply member.

It is preferable that protrusions are provided to increase a contact force with the adjacent terminals in one surface in the terminal of the first power supply member and the terminal of the second power supply member.

Advantageous Effects

In the present invention, the body part forming the socket outlet is formed with the polyhedron shape, and the hinge-coupling parts are provided at both sides of the polyhedron such that the interval of the insertion holes of the plugs or the USB terminal provided in the adjacent body parts may be controlled, thereby allowing successive insertion and use of the plugs having a relatively large size in the socket outlet. Accordingly, the present invention has an effect of convenience of use.

Also, in the present invention, the hinge-coupling part is coupled to the body part and the structure of the hinge coupling part and the power supply member is simple, thereby having an effect of reducing a production cost.

Further, the present invention may manufacture the parts with the same structure such that the number of parts may be reduced, thereby having an effect of reducing a production cost.

In addition, the present invention may be modified into various shapes such that there is an effect of maximizing utilization of space.

DETAILED DESCRIPTION OF THE EMBODIMENTS

Figure 1:
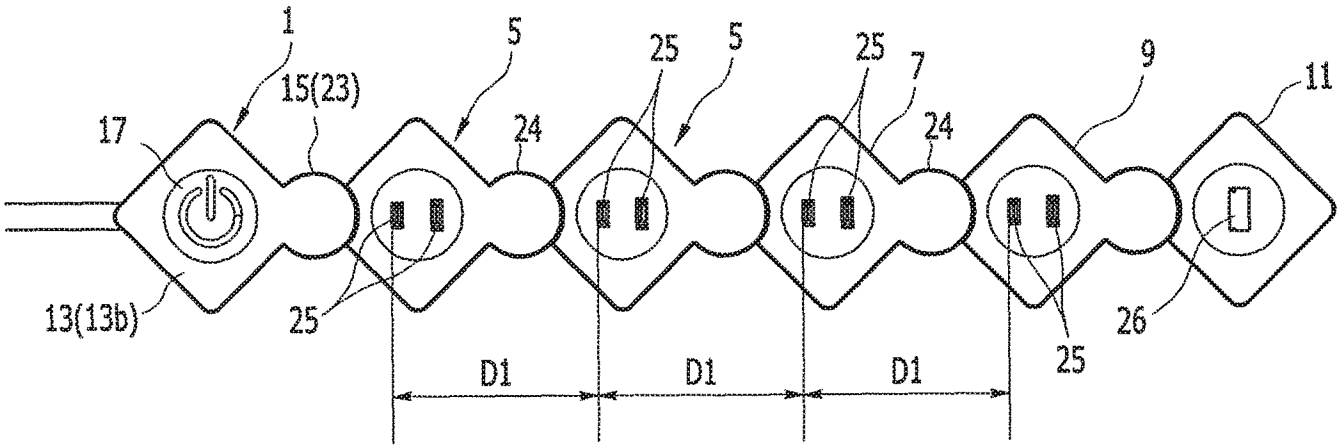
FIG. 1 is a top plan view of a long unfolded state of a socket outlet assembly to explain an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
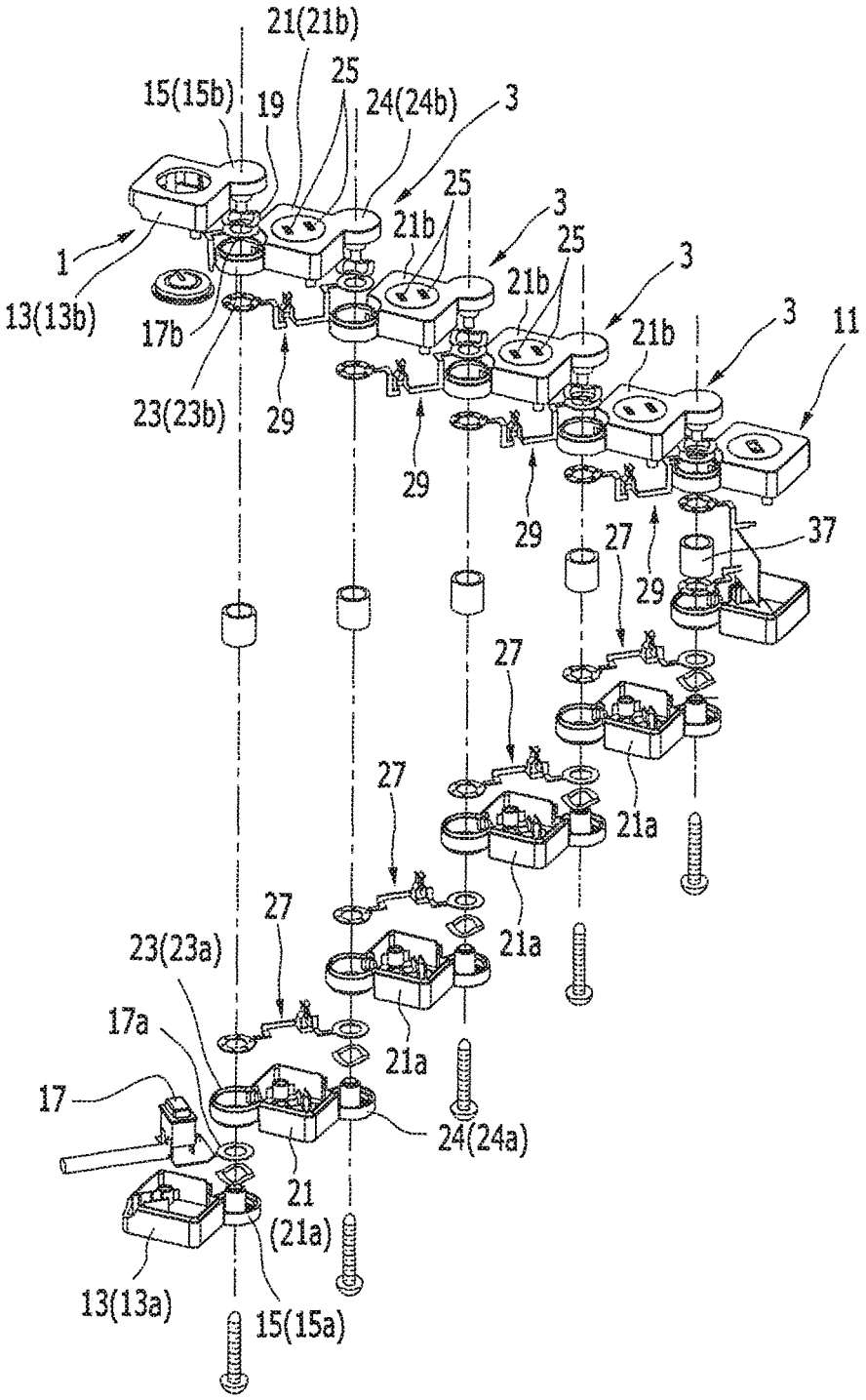
FIG. 2 is an exploded perspective view of FIG. 1.

FIG. 1 is a top plan view of a long unfolded state of a socket outlet assembly to explain an exemplary embodiment of the present invention, and FIG. 2 is an exploded perspective view of FIG. 1.

A socket outlet assembly according to an exemplary embodiment of the present invention includes a power supply unit 1, a plurality of unit socket outlets 3, 5, 7, and 9, and a USB terminal socket outlet 11.

An exemplary embodiment of the present invention may only include the unit socket outlets 3, 5, 7, and 9 in a state that the power supply unit 1 is omitted. Also, in an exemplary embodiment of the present invention, a plurality of USB terminal socket outlets 11 may be successively connected to the unit socket outlets 3, 5, 7, and 9. As another exemplary embodiment of the present invention, a configuration in which the unit socket outlets 3, 5, 7, and 9 and the USB terminal socket outlet 11 are combined with each other is possible.

In the description of an exemplary embodiment of the present invention, the structure in which four unit socket outlets 3, 5, 7, and 9 having the same structure as the power supply unit 1 and the USB terminal socket outlet 11 are sequentially connected with each other will be described. Also, in an exemplary embodiment of the present invention, the unit socket outlets 3, 5, 7, and 9 have the same structure such that one unit socket outlet 3 will be described by providing reference numerals for convenience.

The power supply unit 1 includes a power body part 13, a power hinge-coupling part 15, and a switch 17.

The power body part 13 may be made as a polyhedron. In an exemplary embodiment of the present invention, it is preferable that the power body part 13 is made as a hexahedron. The power body part 13 is provided with the power hinge-coupling part 15 in a corner part side. As shown in FIG. 1, it is preferable that the power hinge-coupling part 15 provided in the power body part 13 is provided in only one side of the corner part. Also, the power body part 13 and the power hinge-coupling part 15 may be integrally formed to each other.

The switch 17 is provided at one surface in the power body part 13. A power plug (not shown) that may be used as a power source by being plugged into a household power socket outlet may be connected to the switch 17. The switch 17 serves to open and close the power through the power plug (not shown).

Figure 3:
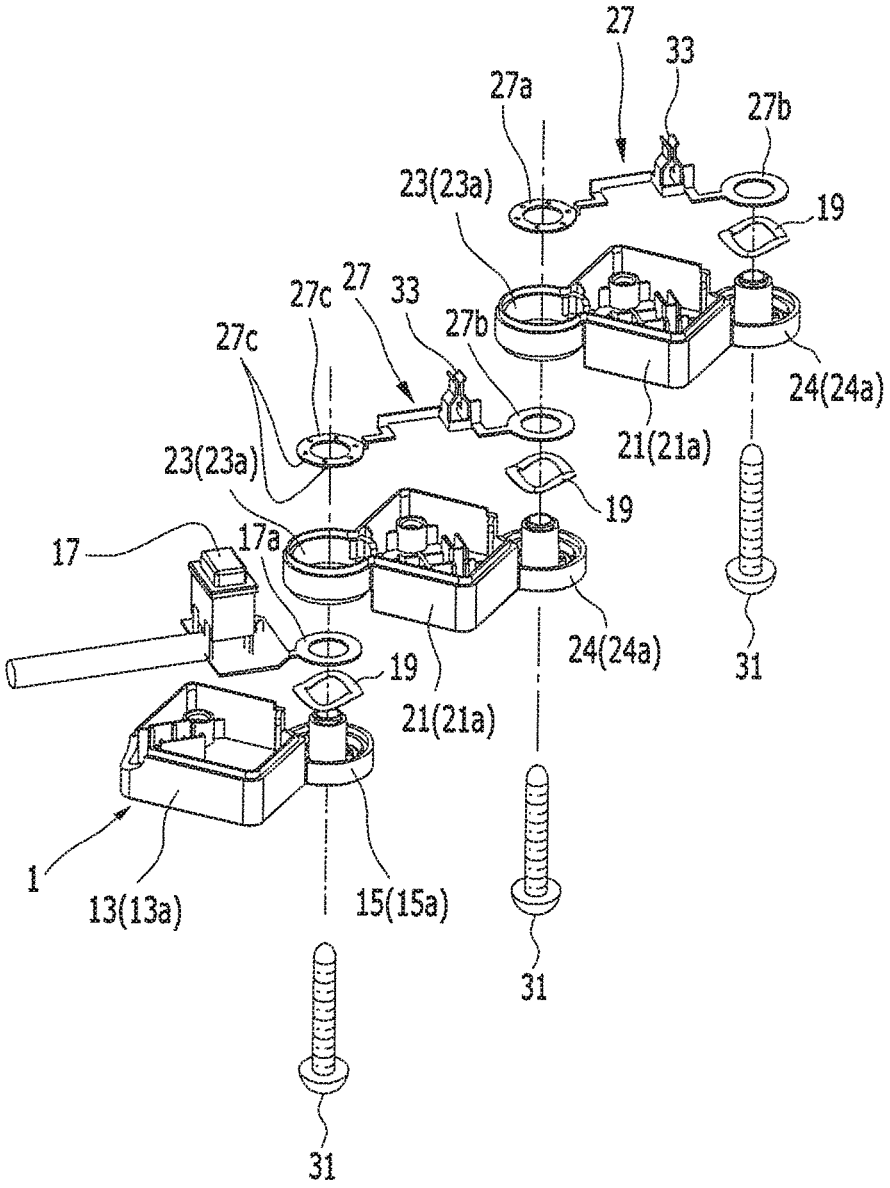
FIG. 3 is an enlarged view of a lower body part in a body part of the socket outlet assembly as a main part of FIG. 2 to explain an exemplary embodiment of the present invention.
Figure 4:
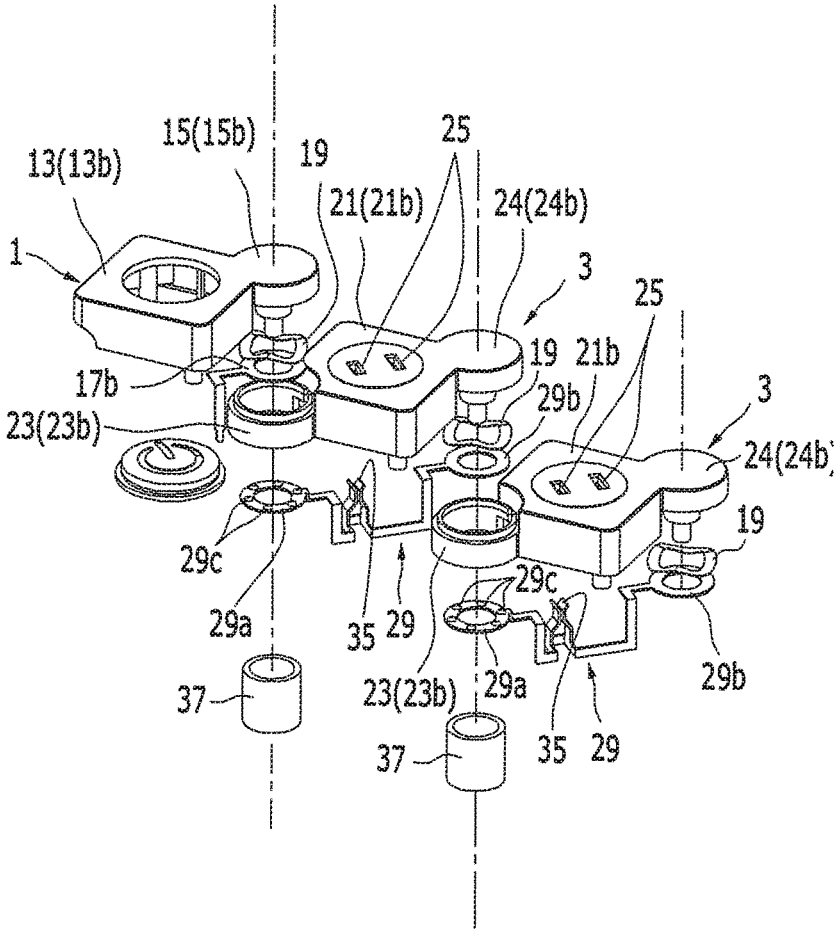
FIG. 4 is an enlarged view of an upper body part in a body part of the socket outlet assembly as a main part of FIG. 2 to explain an exemplary embodiment of the present invention.

On the other hand, the power body part 13, as shown in FIG. 3 and FIG. 4, may be made with a shape such that a lower power body part 13*a* and an upper power body part 13*b* are combined.

A lower power hinge-coupling part 15*a* that is a part of the power hinge-coupling part 15 may be provided at one side of the lower power body part 13*a*, and an upper power hinge-coupling part 15*b* that is the other part of the power hinge-coupling part 15 may be provided at one side of the upper power body part 13*b*.

Also, the first switch terminal 17*a* and the second switch terminal 17*b* for the power supply is connected to the switch 17. The first switch terminal 17*a* is disposed at the side of a lower power hinge-coupling part 15*a*, and the second switch terminal 17*b* is disposed at the side of an upper power hinge-coupling part 15*b*. Front ends of a first switch terminal 17*a* and a second switch terminal 17*b* are formed with a discoid shape with a through-hole at a center portion thereof.

Also, as shown in FIG. 3 and FIG. 4, a wave washer 19 is disposed under the first switch terminal 17*a* and on the second switch terminal 17*b*. In the wave washer 19, a surface forming the washer is formed with a curve so that elastic force is applied in a direction toward the first switch terminal 17*a* or the second switch terminal 17*b*. The wave washer 19 is disposed on the hinge-coupling part 15 of the power body part 13.

The unit socket outlet 3 includes a body part 21, a first hinge-coupling part 23, a second hinge-coupling part 24, an insertion hole part 25, a first power supply member 27, and a second power supply member 29.

The body part 21 may be made as the polyhedron and may be preferably made as the hexahedron. It is preferable that the body part 21 is formed with the same shape as the above-described power body part 13. A lower body part 21*a* and an upper body part 21*b* are combined, thereby forming one body part 21.

The first hinge-coupling part 23 and the second hinge-coupling part 24 may be provided integrally with the body part 21 on facing corner parts at both sides of the body part 21.

The insertion hole part 25 for inserting an additional plug (not shown) may be provided on one surface of the upper body part 21*b* of the body part 21.

In an exemplary embodiment of the present invention, if necessary, it is possible for the insertion hole part 25 to be made as a hole 26 into which the USB terminal is inserted.

The first hinge-coupling part 23, as shown in FIG. 3 and FIG. 4, includes a first lower hinge-coupling part 23*a* and a first upper hinge-coupling part 23*b*.

The first lower hinge-coupling part 23*a* is coupled to the lower body part 21*a*, and the first upper hinge-coupling part 23*b* is coupled to the upper body part 21*b*.

The first hinge-coupling part 23 may be inserted between the lower power hinge-coupling part 15*a* and the upper power hinge-coupling part 15*b* of the power hinge-coupling part 15 provided in the power body part 13.

Also, the second hinge-coupling part 24, as shown in FIG. 3 and FIG. 4, includes a second lower hinge-coupling part 24*a* and a second upper hinge-coupling part 24*b*. The second lower hinge-coupling part 24*a* is coupled to the lower body part 21*a*, and the second upper hinge-coupling part 24*b* is coupled to the upper body part 21*b*.

The above-described first hinge-coupling part 23 may be fastened to the power hinge-coupling part 15 by a fastening member 31. Also, the second hinge coupling part 24 may be fastened to the first hinge-coupling part provided in another unit socket outlet 5 disposed to be adjacent by another fastening member 31.

That is, the first hinge-coupling part 23 is hinge-coupled to the power hinge-coupling part 15, thereby being rotated by a predetermined angle. Likewise, the second hinge-coupling part 24 is hinge-coupled to the first hinge-coupling part provided in another unit socket outlet 5 disposed to be adjacent.

The first power supply member 27 and the second power supply member 29 are provided inside the body part 21, the first hinge-coupling part 23, and the second hinge-coupling part 24.

The first power supply member 27 may be made of a metal material that may be electrically conductive, and includes terminals 27*a* and 27*b* at respective sides of a first plug fitting part 33.

The first plug fitting part 33 is disposed at one side of the insertion hole part 25 provided in the body part 21 for the plug (not shown) to be fitted.

The terminal 27*a* of the first power supply member 27 may be made with a disc plate shape having a hole at the center thereof, and maintains a state of contact with the first switch terminal 17*a*. The other terminal 27*b* of the first power supply member 27 is disposed at the side of the second hinge-coupling part 24.

The second power supply member 29 may be made of a material that may be electrically conductive like the first power supply member 27, and includes terminals 29*a* and 29*b* at respective sides of a second plug fitting part 35.

The second plug fitting part 35 is disposed at the other side of the insertion hole part 25 provided in the body part 21, thereby fitting the plug.

The terminal 29*a* of the second power supply member 29 is made with the disc plate shape having the hole formed at the center thereof, and maintains the state of contact with the second switch terminal 17*b*. The other terminal 29*b* of the second power supply member 29 is disposed at the side of the second hinge-coupling part 24.

A blocking member 37 made of an insulation material is provided between the terminal 27*a* of the first power supply member 27 and the terminal 29*a* of the second power supply member 29.

The blocking member 37 is made with a cylindrical shape, and both ends thereof may be respectively close to the terminal 27*a* of the first power supply member 27 and the terminal 29*a* of the second power supply member 29.

Also, a plurality of protrusions 27*c* and 29*c* are provided on one surface is of the terminal 27*a* of the first power supply member 27 and one surface of the terminal 29*a* of the second power supply member 29, respectively.

The protrusions 27*c* provided at the terminal 27*a* of the first power supply member 27 are preferably disposed to be protruded to the surface toward the first switch terminal 17*a*. Also, other protrusions 29*c* provided at the terminal 29*a* of the second power supply member 29 are preferably disposed to be protruded to the surface toward the second switch terminal 17*b*.

The protrusion 27*c* provided at the terminal 27*a* of the first power supply member 27 maintains the state that the terminal 27*a* of the first power supply member 27 is close to the first switch terminal 17*a* with point contact such that it can provide outstanding energizing performance while being rotated.

Likewise, the protrusions 29*c* provided at the terminal 29*a* of the second power supply member 29 maintains the state that the terminal 29*a* of the second power supply member 29 is close to the second switch terminal 17*b* with point contact such that the energizing performance may be improved while being rotated.

In an exemplary embodiment of the present invention, since the unit socket outlets 3, 5, 7, and 9 have the same structure, the structure of the rest of the unit socket outlets 5, 7, and 9 is replaced with the structure description of the above-described unit socket outlet 3.

In an exemplary embodiment of the present invention, the USB terminal socket outlet 11 is coupled to the unit socket outlet 9. The shape of the USB terminal socket outlet 11 may be formed with the same structure as the above-described unit socket outlet 3, however only one hinge-coupling part may be provided, like the first hinge-coupling part 23.

In the above-described exemplary embodiment of the present invention, the wave washer 19 serves to close the terminal 27*a* of the first power supply member 27 and the first switch terminal 17*a*, and the terminal 29*a* of the second power supply member 29 and the second switch terminal 17*b*, thereby having a role of freely rotating the power supply unit 1 and the unit socket outlet 3 based on the hinge-coupling part while smoothly performing energization. Likewise, the unit socket outlets 3, 5, 7, and 9 may be electrically connected to each other while being rotated based on the hinge-coupling part.

Figure 5:
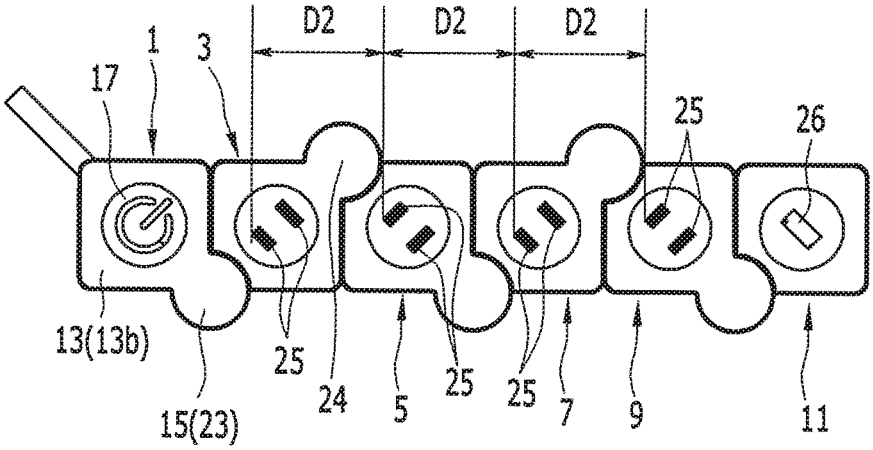
FIG. 5 is a top plan view showing a short folded state of a socket outlet assembly to explain an exemplary embodiment of the present invention.
Figure 6:
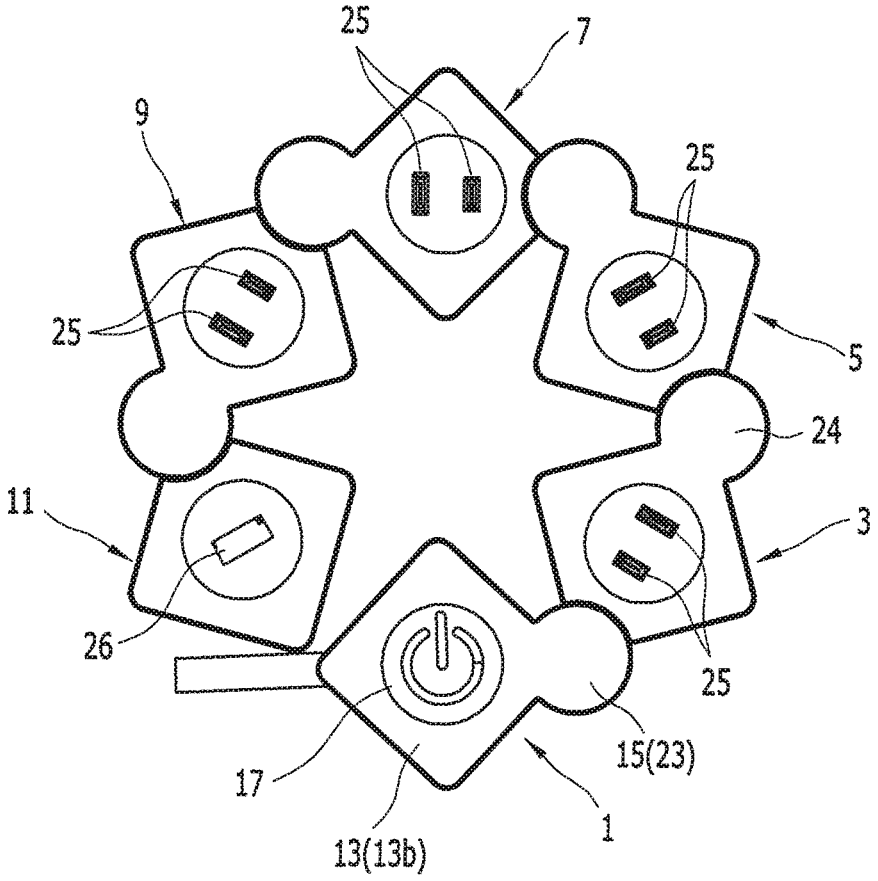
FIG. 6 is a view of another variation of a socket outlet assembly to explain an exemplary embodiment of the present invention.
Figure 7:
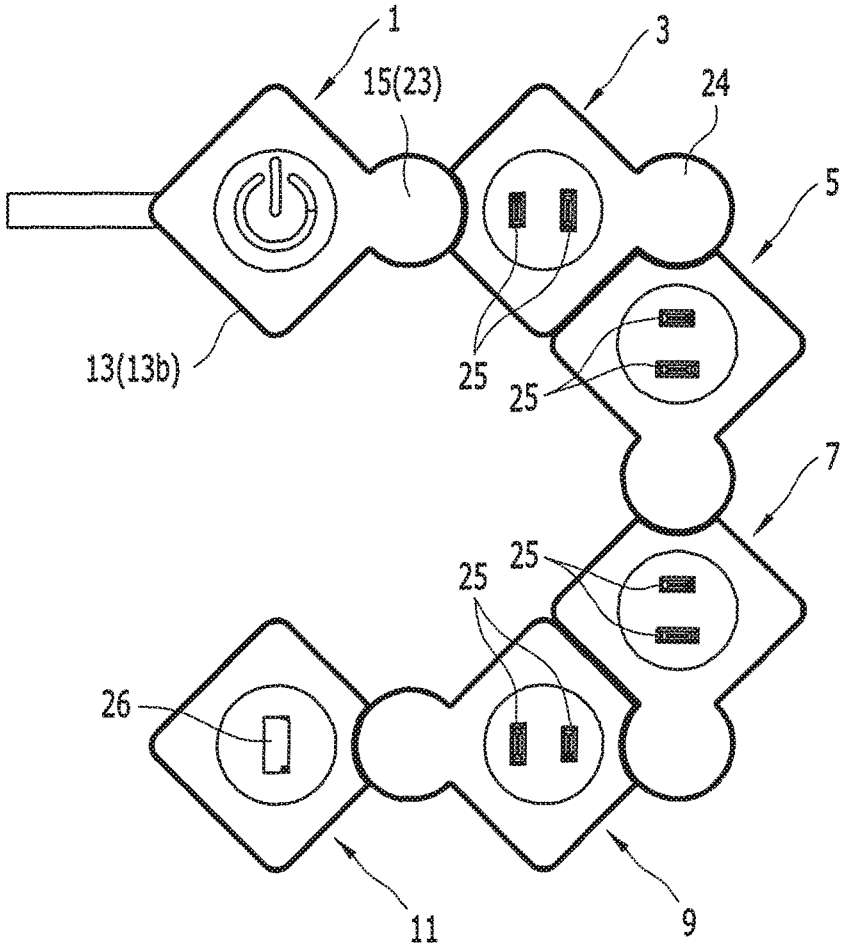
FIG. 7 is a view of another variation of a socket outlet assembly to explain an exemplary embodiment of the present invention.

In an exemplary embodiment of the present invention, in the unfolded state like in FIG. 1, the distance D1 formed by the insertion holes 25 (indicated by the same reference numeral for convenience) provided in the unit socket outlets 3, 5, 7, and 9 disposed to be adjacent may maintain a maximum interval. Accordingly, plugs having a relatively large size may be easily and successively plugged in. Also, as shown in FIG. 5, when disposing the surfaces formed by the body parts 21 to contact each other, the entire length of the socket outlet assembly is reduced. Further, as shown in FIG. 6 to FIG. 7, the socket outlet assembly may be formed of an arbitrary shape by rotating the body part on the hinge-coupling part.

An exemplary embodiment of the present invention may control the shape of the socket outlet assembly and the length thereof such that there is a merit that the use is convenient. Particularly, in an exemplary embodiment of the present invention, the hinge coupling structure connecting the power supply unit 1 and the unit socket outlets 3, 5, 7, and 9 is simple such that the production cost may be reduced.

Also, in an exemplary embodiment of the present invention, the parts may be manufactured with the same structure such that the kinds of the parts may be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A socket outlet assembly including a plurality of unit socket outlets hinge-coupled to each other and having a varied shape, wherein each unit socket outlet includes a body part made as a hexahedron, one or more hinge-coupling part integrally made with the body part and provided at a corner part side of the body part, an insertion hole part inserted with a plug in one surface of the body part, and a first power supply member and a second power supply member provided at the body part and the hinge-coupling part and supplying power from a power source to the insertion hole part, wherein the hinge-coupling part is disposed on a pair of corner parts facing each other in a diagonal direction in a case that the body part is disposed between other body parts in a top plan view, the unit socket outlet is connected with a power supply unit, and the power supply unit includes a power body part made as a hexahedron, a power hinge-coupling part integrally made with the power body part and provided at a corner part side of the power body part in a top plan view, and a switch provided at the body part and supplying or blocking power from the power source to the first power supply member and the second power supply member, and the power hinge-coupling part provided at the power body part is hinge-coupled to the hinge-coupling, part provided at the body part.

2. The socket outlet assembly of claim 1, wherein:

the unit socket outlet is made as a USB socket outlet in which one or more USB terminals can be inserted.

3. The socket outlet assembly of claim 1, wherein:

the body part includes a lower body part, and an upper body part coupled to the lower body part, the hinge-coupling part includes a lower hinge-coupling part extending from the corner part side of the lower body part, and an upper hinge-coupling part extending from the corner part side of the upper body part, and the lower hinge-coupling part and the upper hinge-coupling part are coupled to another lower hinge-coupling part and another upper hinge-coupling part disposed to be adjacent by a fastening member.

4. The socket outlet assembly of claim 1, wherein:

the first power supply member has a terminal at the first plug fitting part and at both sides thereof, the terminal of the first power supply member is disposed at the hinge-coupling part and contacts the terminal of another adjacent first power supply member, the second power supply member includes another terminal at the second plug fi part and both sides, the terminal of the second power supply member is disposed at the hinge-coupling part and contacts the terminal of another adjacent second power supply member, and the terminal of the first power supply member and the terminal of the second power supply member are insulated by a blocking member provided at the hinge-coupling part.

5. The socket outlet assembly of claim 4, wherein:

the blocking member is made with a cylindrical shape and is disposed between the terminal of the first power supply member and the terminal of the second power supply member.

6. The socket outlet assembly of claim 4, wherein:

in the hinge-coupling part, a wave washer is respectively disposed at one side of the terminal of the first power supply member and the terminal of the second power supply member, and the wave washer has elastic force acting in a direction that the terminal of the first power supply member maintains the contact state with the terminal of another adjacent first power supply member and the terminal of the second power supply member maintains the contact state with the terminal of another adjacent second power supply member.

7. The socket outlet assembly of claim 4, wherein:

in the terminal of the first power supply member and the terminal of the second power supply member, protrusions are provided to increase a contact force with the adjacent terminals in one surface.

* * * * *